US010920779B2

(12) United States Patent
Tsugihashi

(10) Patent No.: US 10,920,779 B2
(45) Date of Patent: Feb. 16, 2021

(54) PACKAGE-TYPE AIR-COOLED SCREW COMPRESSOR HAVING A COOLING AIR EXHAUST OPENING IN THE PACKAGE WITH A DUCT EXTENDED DOWNWARD WITH A LOWER-END INLET PLACED NOT VIEWABLE FROM THE CENTER POSITION OF THE COMPRESSOR

(71) Applicant: KOBE STEEL, LTD., Hyogo (JP)

(72) Inventor: Kazuki Tsugihashi, Hyogo (JP)

(73) Assignee: KOBE STEEL, LTD., Hyogo (JP)

( * ) Notice: Subject to any disclaimer, the term of this patent is extended or adjusted under 35 U.S.C. 154(b) by 219 days.

(21) Appl. No.: 15/740,289

(22) PCT Filed: Jun. 7, 2016

(86) PCT No.: PCT/JP2016/066880
§ 371 (c)(1),
(2) Date: Dec. 27, 2017

(87) PCT Pub. No.: WO2017/006687
PCT Pub. Date: Jan. 12, 2017

(65) Prior Publication Data

US 2018/0187684 A1 Jul. 5, 2018

(30) Foreign Application Priority Data

Jul. 3, 2015 (JP) ..... 2015-134117

(51) Int. Cl.
*F04C 29/04* (2006.01)
*F04C 18/16* (2006.01)
(Continued)

(52) U.S. Cl.
CPC ..... *F04C 29/042* (2013.01); *F04C 18/16* (2013.01); *F04C 29/0085* (2013.01);
(Continued)

(58) Field of Classification Search
CPC .. F04C 18/16; F04C 2240/40; F04C 29/0085; F04C 29/04; F04C 29/042; F04C 29/063;
(Continued)

(56) References Cited

U.S. PATENT DOCUMENTS 1,439,628 A * 12/1922 Kien ..... F04C 18/16 418/85
2,764,948 A * 10/1956 Jones ..... F24F 13/20 417/410.1
(Continued)

FOREIGN PATENT DOCUMENTS

JP 2004-324615 A 11/2004
JP 2005-030227 A 2/2005
(Continued)

OTHER PUBLICATIONS

International Search Report; issued in PCT/JP2016/066880; dated Sep. 13, 2016.
(Continued)

*Primary Examiner* — Devon C Kramer
*Assistant Examiner* — Benjamin Doyle
(74) *Attorney, Agent, or Firm* — Studebaker & Brackett PC

(57) ABSTRACT

A package-type air-cooled screw compressor has a compressor body relating to an air-cooled screw compressor, a drive motor, a package that houses the compressor body and the drive motor, an intake opening that takes in an air that cools the compressor body and the drive motor, an exhaust opening that exhausts the air, a duct extended downward from the exhaust opening, to transport the air to the exhaust opening, and an exhaust fan that exhausts the air. A lower end of a wall face constituting the duct is extended downward so that a lower-end inlet of the duct is placed at a position not viewable from a center position of the compressor body.

8 Claims, 19 Drawing Sheets

(51) Int. Cl.
*F04C 29/06* (2006.01)
*F04C 29/00* (2006.01)
*F04C 29/12* (2006.01)

(52) U.S. Cl.
CPC ..... *F04C 29/04* (2013.01); *F04C 29/063* (2013.01); *F04C 29/066* (2013.01); *F04C 29/12* (2013.01); *F04C 2240/40* (2013.01)

(58) Field of Classification Search
CPC ..... F04C 29/066; F04C 29/12; F04C 23/005; F04C 29/068
USPC ..... 417/410.4
See application file for complete search history.

(56) References Cited

U.S. PATENT DOCUMENTS 3,989,415 A * 11/1976 Van-Hee ..... F02B 77/13 417/312
4,264,282 A * 4/1981 Crago ..... F04C 29/066 181/202
4,725,210 A * 2/1988 Suzuki ..... F04C 29/04 418/101
4,929,161 A * 5/1990 Aoki ..... F04C 29/04 418/101
5,222,874 A * 6/1993 Unnewehr ..... F04C 29/042 417/372
5,507,618 A * 4/1996 Kubo ..... F04C 23/00 165/47
5,575,349 A * 11/1996 Ikeda ..... F02B 63/04 123/41.7
6,193,486 B1 * 2/2001 Shiinoki ..... B01D 53/26 418/101
6,345,960 B1 * 2/2002 Persson ..... A01J 11/16 417/313
6,629,825 B2 * 10/2003 Stickland ..... F04B 35/04 417/360
6,638,030 B2 * 10/2003 Nishimura ..... F04C 18/16 417/297
6,666,661 B2 * 12/2003 Dieterich ..... F04C 23/008 417/410.4
8,317,494 B2 * 11/2012 Pileski ..... F01C 21/10 310/71
8,500,424 B2 * 8/2013 Feller ..... F04C 18/16 418/201.1
2005/0063844 A1 * 3/2005 Sato ..... F01C 21/007 417/423.5
2006/0280626 A1 * 12/2006 Nishimura ..... F01C 21/007 417/410.4
2010/0135840 A1 * 6/2010 Fujimoto ..... F04B 39/0033 418/201.1
2011/0182762 A1 * 7/2011 Feller ..... F04C 18/16 418/206.7
2013/0136643 A1 * 5/2013 Yabe ..... F04C 29/04 418/83
2014/0086728 A1 * 3/2014 Engert ..... F04D 29/547 415/119
2014/0159442 A1 * 6/2014 Helmenstein ..... B60N 2/5671 297/180.14
2014/0314586 A1 * 10/2014 Kanaizumi ..... F04C 23/001 417/362
2015/0139778 A1 * 5/2015 Fong ..... F03D 1/02 415/4.4
2016/0097389 A1 * 4/2016 Yamazaki ..... F01C 21/007 417/410.5

FOREIGN PATENT DOCUMENTS

JP 2013-113236 A 6/2013
JP 2014-051946 A 3/2014
JP 2015-075072 A 4/2015

OTHER PUBLICATIONS

Written Opinion; issued in PCT/JP2016/066880; dated Sep. 13, 2016.

* cited by examiner

-PRIOR ART-

-PRIOR ART-

-PRIOR ART-

-PRIOR ART-

-PRIOR ART-

PACKAGE-TYPE AIR-COOLED SCREW COMPRESSOR HAVING A COOLING AIR EXHAUST OPENING IN THE PACKAGE WITH A DUCT EXTENDED DOWNWARD WITH A LOWER-END INLET PLACED NOT VIEWABLE FROM THE CENTER POSITION OF THE COMPRESSOR

TECHNICAL FIELD

The present invention relates to a package-type air-cooled screw compressor having an air-cooled screw compressor installed inside a package.

BACKGROUND ART

As described in Patent Document 1, for example, a package-type air-cooled screw compressor having an air-cooled screw compressor installed inside a package incorporates, inside its package, devices such as an air-cooled screw compressor, a drive motor for driving the screw compressor, and a heat exchanger for cooling the compressed air discharged from the screw compressor and the lubricant oil of the screw compressor. Furthermore, the package-type air-cooled screw compressor is required to take in cooling air for cooling these built-in devices and compressing air to be compressed from the outside of the package to the inside of the package.

Hence, the package-type air-cooled screw compressor has an intake opening for taking in cooling air from the outside and an exhaust opening for exhausting the cooling air after the cooling of the built-in devices such as the screw compressor. These openings cause the noise generated from the built-in devices to leak to the outside of the package. Accordingly, in the package-type air-cooled screw compressor, how to satisfy both the cooling of the built-in devices and the leakage suppression of the noise generated from the built-in devices has become an important technical issue.

As illustrated in FIG. 10*a* to FIG. 10*d* as examples, a conventional package-type air-cooled screw compressor is provided with, in a package 104, a first intake opening 102 for mainly taking in cooling air for a compressor body 101 of the screw compressor and a second intake opening 103 for mainly taking in cooling air for a drive motor 105 for driving the screw compressor. Part of the air taken in from the first intake opening 102 is also used as air for compression to be compressed by the compressor body 101.

Furthermore, the cooling air taken into the package 104 cools the compressor body 101, the drive motor 105, etc., and thereafter is sucked into a duct 106 and passes through a heat exchanger 107 and is then exhausted from an exhaust opening 108. The heat exchanger 107 provided in the exhaust opening 108 is one that cools the compressed air compressed by the screw compressor and lubricant oil. In this kind of conventional package-type air-cooled screw compressor, as a countermeasure for noise leakage from the intake openings, soundproof plates 109 and 110 are provided so as to be opposed to the first intake opening 102 and the second intake opening 103, respectively. The solid line arrows and the broken line arrows in FIG. 10*a* to FIG. 10*c* indicate the flow of the cooling air or the compressed air. Moreover, the front-rear direction and the left-right direction in FIG. 10*d* are the directions of the arrows shown in the figure.

PRIOR ART DOCUMENT

Patent Document

Patent Document 1: JP-A-2013-113236

SUMMARY OF THE INVENTION

Problem that the Invention is to Solve

In the conventional package-type air-cooled screw compressor, since the soundproof plates 109 and 110 are provided so as to be opposed to the first intake opening 102 and the second intake opening 103 while leaving a clearance for an air passage, the soundproof plates are effective as the countermeasure for noise leakage. However, since the heat exchanger 107 provided in the exhaust opening 108 has a ventilation passage capable of exhausting air and soundproof countermeasures are not particularly provided on the side of the exhaust opening, noise is in a state of leaking from the exhaust opening 108. Furthermore, since the lower-end inlet 106A of the duct 106 is provided at a position above the compressor body 101 that is the main source of the noise, the noise emitted from the surface of the compressor body 101 is in a state of being easily propagated into the duct 106.

On the basis of these analyses, the present inventor has noticed that countermeasures for noise leakage from the exhaust opening are not particularly provided for a conventional package-type air-cooled screw compressor and have found that it is very effective to suppress the noise emitted from the compressor body, which is the main source of the noise, from being discharged from the exhaust opening.

The present invention has been made in consideration of the above-mentioned circumstances and is intended to provide a package-type air-cooled screw compressor satisfying that the noise emitted from the compressor body is suppressed from leaking from the exhaust opening and also satisfying that the compressor body is cooled.

Means for Solving the Problem

A package-type air-cooled screw compressor for solving this problem has a compressor body relating to an air-cooled screw compressor equipped with a screw rotor for compression; a drive motor that drives the screw compressor; a package that houses the compressor body and the drive motor; an intake opening formed in the package, for taking in an air that cools the compressor body and the drive motor; an exhaust opening formed in an upper section of the package, to exhaust the air after the cooling of the compressor body and the drive motor; a duct extended downward from the exhaust opening, to transport the air after the cooling of the compressor body and the drive motor to the exhaust opening; and an exhaust fan that exhausts the air after the cooling of the compressor body and the drive motor, in which a lower end of a wall face constituting the duct is extended downward so that a lower-end inlet of the duct is placed at a position not viewable from a center position of the compressor body.

In the above descriptions, "a center position of the compressor body" is, on the surface of a casing of the compressor body housing two female/male screw rotors, a position of the horizontal plane passing through the center axes of the two screw rotors, i.e., a position on the surface close to the duct. In the case that the two female/male screw rotors are not positioned on a single horizontal plane, it is a position on the horizontal plane passing through the center axis of the screw rotor closer to the duct. Furthermore, "a lower end of a wall face constituting the duct" is the lower end position of the wall face constituting the duct; however, the lower end positions of each of the wall faces are not required to be constant, and the lower end shapes of each of the wall faces are not limited to be horizontal but may have various shapes, for example, an inclined shape, provided that they satisfy the condition that the lower-end inlet is not viewable from the center position of the compressor body.

Since the compressor body is generally configured such that the two female/male screw rotors are housed inside the casing that has an oval cross-sectional shape having a major diameter in the horizontal direction, the portion of the casing below the center position has a shape of half of the oval shape protruding downward. Hence, the noise emitted from the portion of the casing below the center position of the compressor body is directed downward, whereby the portion of the casing below the center position of the compressor body is originally not placed at a position capable of viewing the duct. On the other hand, the noise emitted from the portion of the casing above the center position of the compressor body is directed upward; however, in the case of the above-mentioned configuration, since the lower-end inlet of the duct is not viewable from the center position of the compressor body, the noise emitted from the portion of the casing above the center position is insulated by the wall faces of the duct. Hence, the noise emitted from the portion of the casing above the center position is propagated while passing around the lower ends of the wall faces of the duct, whereby the noise is diffracted and attenuated. As a result, the noise to be propagated to the exhaust opening via the duct is suppressed. Furthermore, since the lower end of the duct is extended downward as described above, the air flow for cooling the compressor body can easily be made to pass along the lower section of the compressor body, whereby the cooling effect for the compressor body can be improved.

The lower end of the wall face of the duct may be extended downward so that the lower-end inlet is not viewable from both the center position of the compressor body and a center position of the drive motor.

In the above descriptions, "the center position of the drive motor" is a position on the surface of a casing of the drive motor and the position of the horizontal plane passing through the center axis of the drive motor, i.e., a position on the surface of the casing close to the duct. Furthermore, "the lower end of the wall face of the duct" in this case may merely be required to satisfy the condition that the lower-end inlet is not viewable from the center positions of the compressor body and the drive motor.

The drive motor generally has a nearly cylindrical casing. Hence, the portion of the casing below the center position is formed into a circular arc shape protruding downward, whereby the noise emitted from the portion of the casing below the center position is directed downward as in the case of the compressor body. Therefore, the lower portion of the casing of the drive motor is originally not placed at a position capable of viewing the duct.

On the other hand, the noise emitted from the portion of the casing above the center position of the drive motor is directed upward. However, with the above-mentioned configuration, since the lower-end inlet of the duct is not viewable from the center position of the drive motor, the noise emitted from the portion of the casing above the center position is insulated by the wall faces of the duct extended downward.

For this reason, in the case of the above-mentioned configuration, since the lower-end inlet of the duct is not viewable from both the center position of the compressor body and the center position of the drive motor, the noise emitted from both the portions of the casings above the center positions is insulated by the wall faces of the duct extended downward. Hence, the noise emitted from the portions of the casings above both the center positions is propagated while passing around the lower ends of the wall faces of the duct, whereby the noise is diffracted and attenuated. Hence, the noise propagated to the exhaust opening via the duct is suppressed. Furthermore, since the lower ends of the wall faces of the duct are extended downward as described above, the air flow for cooling the compressor body and the drive motor can easily be made to pass along the lower sections of the compressor body and the drive motor, whereby the cooling effect for the compressor body and the drive motor can be improved.

Furthermore, the compressor body and the drive motor may be connected in a single axial direction and disposed in a bottom section of the package.

The phrase stating that the compressor body and the drive motor are "connected in a single axial direction" herein includes a case in which a drive shaft of the compressor body and a drive shaft of the drive motor are composed of the same shaft and a case in which they are connected coaxially via a coupling, or means a case in which they are connected in series in the axial direction via a gear box.

With this configuration, since the center position of the compressor body and the center position of the drive motor are set so as to have almost the same height, it becomes easy to extend downward so that the lower-end inlet of the duct is not viewable from both the center position of the compressor body and the center position of the drive motor. Furthermore, since the compressor body and the drive motor, heavy devices, are disposed in the bottom section of the package, the configuration can be made simple.

Moreover, in a case where the screw compressor is composed of a plurality of compressors, the lower end of the wall face of the duct may be extended downward so that the lower-end inlet is not viewable from the center position of the compressor body relating to a screw compressor at the lowest position.

With this configuration, since the noise emitted from the plurality of compressor bodies is entirely diffracted and attenuated and then propagated to the duct, the noise to be propagated to the exhaust opening via the duct is suppressed. Furthermore, since the lower end of the duct is extended downward as described above, the cooling air can be supplied to the plurality of compressor bodies so as to flow along the lower sections of each of the compressors, and the effect of cooling the compressor bodies and the drive motor can be improved.

Furthermore, the screw compressor may have an air intake port that sucks in an air for compression, and this air intake port may be disposed at a position not capable of viewing the lower-end inlet of the duct.

With this configuration, the noise of the compression mechanism inside the compressor body leaking from the air intake port is insulated by the wall faces of the duct, diffracted and attenuated and then propagated into the duct, whereby the noise propagated to the exhaust opening via the duct is suppressed.

Moreover, the intake opening may have a first intake opening that takes in a cooling air that mainly cools the compressor body and the air for compression to be sucked into the compressor body, and the air intake port may be provided in a middle of a flow of the cooling air flowing from the first intake opening to the compressor body.

With this configuration, since the air before being heated by the compressor body is sucked into the compressor body from the air intake port, the temperature of the intake air of the compressor body is lowered, and the intake efficiency of the compressor can be improved.

Furthermore, the first intake opening may be formed at a position above the air intake port and the compressor body.

With this configuration, the air taken in from the outside of the package is blown from the first intake opening provided at the upper position to the compressor body provided at the lower position, the air for compression sucked in from the air intake port is less adversely affected by the heat of the compressor body.

Still further, a turbo fan may be used as the exhaust fan and the duct may include an exhaust duct on a blowing side of the turbo fan, being provided between the turbo fan and the exhaust opening, and an intake duct on an intake side of the turbo fan, having a cross-sectional area smaller than that of the exhaust duct, in which the lower-end inlet of the duct may be a lower-end inlet of the intake duct.

With this configuration, the area of the lower-end inlet of the duct can be made smaller, whereby the noise insulating effect, diffraction and attenuation by the duct can be further enhanced.

Advantage of the Invention

With the above-mentioned invention, the leaking of the noise propagated via the duct from the exhaust opening is suppressed, and the cooling affect of the compressor body is improved.

MODE FOR CARRYING OUT THE INVENTION

Package-type air-cooled screw compressors according to embodiments will be described below referring to drawings. However, it is intended that the present invention is not limited to the examples described below, but that the invention will include all modifications indicated by the scope of the claims and falling within the equivalent meanings and the scope of the claims.

Embodiment 1

Figure 1A:
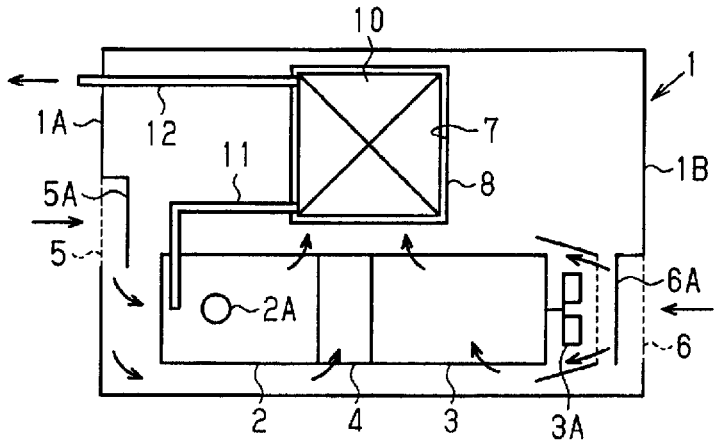
FIG. 1*a* is a schematic view explaining a configuration of a package-type air-cooled screw compressor according to Embodiment 1 and is a plan view thereof.
Figure 1B:
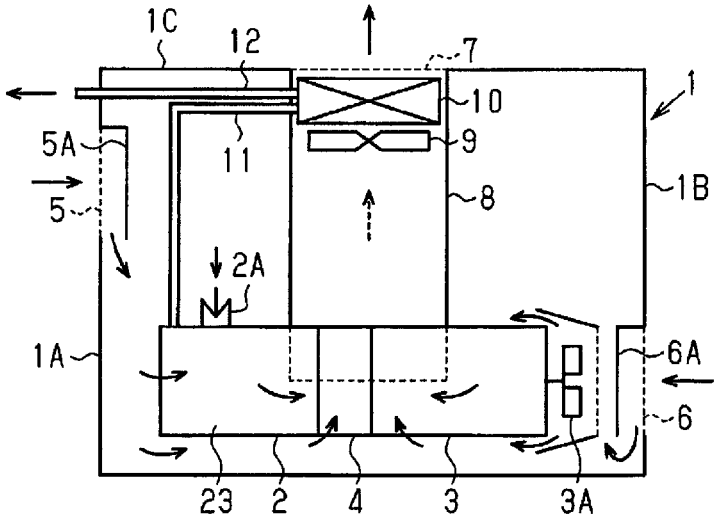
FIG. 1*b* is a front view of the screw compressor of FIG. 1*a*.
Figure 1C:
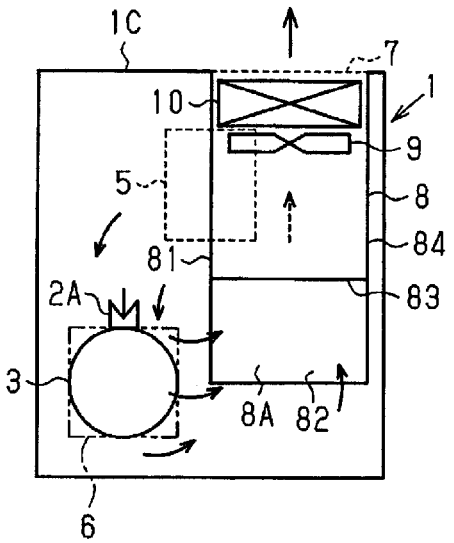
FIG. 1*c* is a right side view of the screw compressor of FIG. 1*a*.

As illustrated in FIG. 1*a*, FIG. 1*b* and FIG. 1*c*, a package-type air-cooled screw compressor according to Embodiment 1 houses a compressor body 2 equipped with screw rotors for compression, a drive motor 3 for driving the compressor body 2, and a gear box 4 for connecting the compressor body 2 and the drive motor 3 inside a package 1.

In this Embodiment, the compressor body 2 is the main body of a screw compressor serving as an oil-cooled type in which lubricant oil is injected during a compression process and also serving as an air-cooled type in which compressed air and lubricant oil are cooled by cooling air. Furthermore, this screw compressor has an air intake port 2A for sucking in air for compression subjected to compression at the upper section of the casing of the compressor body 2. In addition, the air intake port 2A is provided with a throttle valve. The present invention is applicable to not only the above-mentioned oil-cooled type but also an air-cooled screw compressor of water-jet type and oil-free type.

The drive motor 3 is equipped with a dedicated cooling fan 3A for cooling the drive motor 3 itself on an external section of one side.

Furthermore, the compressor body 2 and the drive motor 3 are connected in a single axial direction via a gear box 4 and are disposed in the bottom section of the package 1 so that the package 1 and the like have simplified structures.

The phrase stating that the compressor body 2 and the drive motor 3 are "connected in a single axial direction" herein includes a case in which the drive shaft of the compressor body 2 and the drive shaft of the drive motor 3 are connected using the same shaft and a case in which they are connected coaxially via a coupling, or means a case in which they are connected in series in the axial direction via a gear box. In the case in which they are connected in series in the axial direction via the gear box, the axial center of the compressor body and the axial center of the drive motor are usually deviated slightly. In this embodiment, the compressor body 2 and the drive motor 3 are connected via the gear box 4 as described above.

Furthermore, in the package-type air-cooled screw compressor according to this embodiment, an air intake opening for taking in cooling air is separated into two: a first intake opening 5 and a second intake opening 6, and formed in the package 1.

The first intake opening 5 is one mainly for taking in cooling air for cooling the compressor body 2 and the gear box 4 and intake air to be sucked into the compressor body 2. Moreover, in this embodiment, the first intake opening 5 is provided in a left side plate 1A serving as a side plate of the package 1 on the left side of the compressor body 2. The position of the first intake opening 5 in the left side plate 1A is above the compressor body 2 and the air intake port 2A. Hence, this is configured such that the air taken in from the first intake opening 5 flows to the compressor body 2 via the circumference of the air intake port 2A. Further, inside the first intake opening 5, a soundproof plate 5A for preventing the leakage of the noise emitted from the compressor body 2 and the like is provided so as to be opposed to the first intake opening 5.

The second intake opening 6 is one mainly for taking in cooling air for cooling the drive motor 3 and is provided in a right side plate 1B serving as a side face of the package 1 close to the cooling fan 3A of the drive motor 3. The installation position of the second intake opening 6 is the position opposed to the cooling fan 3A so that the air flow to the drive motor 3 occurs smoothly. Furthermore, inside the second intake opening 6, a soundproof plate 6A for preventing the leakage of the noise emitted from the drive motor 3 and the like is provided so as to be opposed to the second intake opening 6.

Moreover, in a top plate IC of the package 1, an exhaust opening 7 for exhausting the air after the cooling of the compressor body 2, the gear box 4 and the drive motor 3 is provided. In addition, a cooling duct 8 (duct) hangs down from this exhaust opening 7.

The installation position of the exhaust opening 7 is not limited to only the top plate 1C, it may merely be the upper section of the package 1 including the upper end section of a side plate, for example. Furthermore, the cooling duct 8 is not necessarily required to hang down, but may merely be disposed so as to be extended obliquely downward. Further, the cooling duct may have a bent portion. These are similarly applicable to the other embodiments described later.

The cooling duct 8 is one for guiding the air after the cooling of the compressor body 2, the gear box 4 and the drive motor 3 to the exhaust opening 7. Furthermore, inside the cooling duct 8, a propeller fan 9 serving as an exhaust fan for exhausting the cooling air is disposed. In addition, on the blow-out side of the propeller fan 9 inside the cooling duct 8 and in the vicinity of the exhaust opening 7, an air-cooled heat exchanger 10 is disposed so as to close the exhaust opening 7.

Although the heat exchanger 10 is illustrated in FIG. 1 as a single device to simplify the drawing, it is assumed in this embodiment to include an after cooler for cooling the compressed air compressed by the compressor body 2 and an oil cooler for cooling the lubricant oil of the compressor body 2. This is similarly applicable to the following drawings. The oil cooler and the after cooler may be formed separately and both disposed on the same plane parallel to the exhaust opening 7 in the vicinity of the exhaust opening 7 or may be disposed in the vicinity of the exhaust opening 7 so as to be overlapped entirely or partially in the flow direction of the air. Furthermore, the pipe 11 connecting the compressor body 2 and the heat exchanger 10 in FIG. 1 indicates a pipe for guiding the compressed air compressed by the compressor body 2 to the heat exchanger 10. The compressed air cooled by the heat exchanger 10 passes through a pipe 12 and is supplied to a necessary place (not shown). However, the heat exchanger 10 is not necessarily required to be disposed inside the cooling duct 8 (this is similarly applicable to the other embodiments). In this case, the cooling duct 8 does not serve as a cooling duct but merely serves as a duct for guiding the air after the cooling of the compressor body 2 and the like to the exhaust opening 7. Moreover, since FIG. 1 is a simplified schematic view, lubricant oil piping is omitted. This is similarly applicable to the following drawings.

In addition, in this embodiment, for the purpose of suppressing the leakage of the noise from the exhaust opening 7, the lower ends of the hanging wall faces constituting the cooling duct 8 are extended downward so that the lower-end inlet 8A of the cooling duct 8 is placed at a position not viewable from the center position X of the compressor body 2.

Figure 1D:
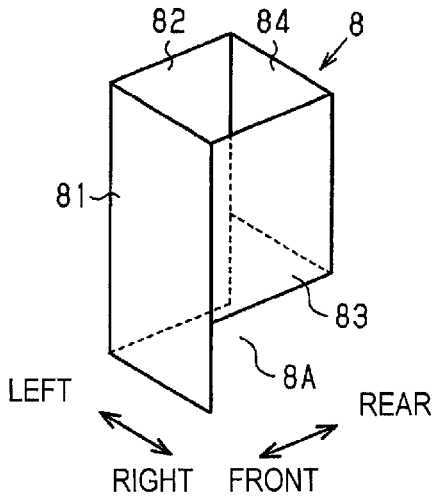
FIG. 1*d* is a perspective view of the cooling duct of FIG. 1*a*.

As illustrated in FIG. 1*d*, the cooling duct 8 has a cross-sectional shape being formed into a nearly square shape, and is composed of the hanging wall faces including a front wall 81, a left side wall 82, a right side wall 83, and a rear wall 84.

The center position X of the compressor body 2" described above will herein be explained. In other words, as illustrated in FIG. 2*a,* in the present description, it is assumed that "the center position X of the compressor body 2" is, on the surface of the casing 23 of the compressor body 2 housing two female/male screw rotors 21 and 22, the position of the horizontal plane passing through the center axes CL of the two screw rotors 21 and 22, i.e., the position on the surface close to the cooling duct 8.

Figure 2A:
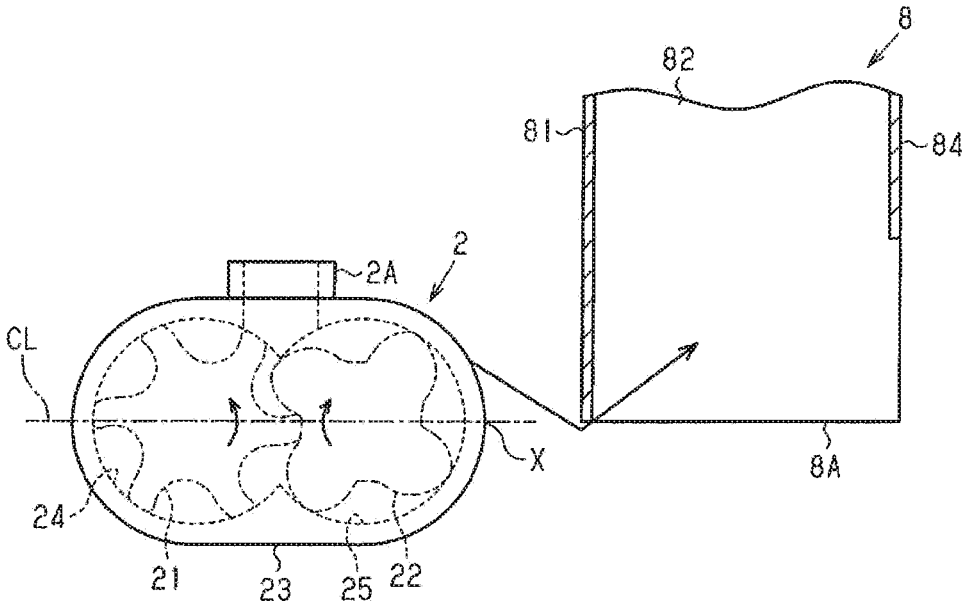
FIG. 2*a* is a schematic view illustrating the positional relationship between the compressor body and the cooling duct in the package-type air-cooled screw compressor according to Embodiment 1.

As illustrated in FIG. 2*a,* the compressor body 2 in this embodiment has a general structure, and the two female/male screw rotors 21 and 22 are housed in the bores 24 and 25 in the casing. 23 that has an oval cross-sectional shape having a major diameter in the horizontal direction. Hence, the outer peripheral surface of the casing 23 is formed into a nearly oval cross-sectional shape.

Accordingly, the portion of the casing 23 below the center position X of the compressor body 2 is formed into a cross-sectional shape of half of oval shape protruding downward. Hence, the noise emitted from the portion of the casing 23 below the center position X is directed downward, whereby the portion of the casing 23 below the center position X is originally not placed at a position capable of viewing the lower-end inlet 8A of the cooling duct 8.

On the other hand, the noise emitted from the portion of the casing 23 above the center position X of the compressor body 2 is directed upward. In addition, the lower-end inlet 8A on the side of the cooling duct 8 is formed at a position not viewable from the center position X of the compressor body 2.

As described above, the lower ends of the hanging wall faces constituting the cooling duct 8 are extended so that the lower-end inlet 8A on the side of the cooling duct 8 is placed at a position not viewable from the center position X of the compressor body 2. In the present description, "the lower ends of the hanging wall faces constituting the cooling duct 8" are the lower end positions of the front wall 81, the left side wall 82, the right side wall 8,3 and the rear wall 84 constituting the hanging wall faces of the cooling duct 8. However, these lower end positions of the hanging wall faces are not required to be a constant position, and the lower end shapes of each of the hanging wall faces may be horizontal one or inclined one, provided that they satisfy the condition that the lower-end inlet 8A is not viewable from the center position X of the compressor body 2.

As illustrated in FIG. 1*d,* in the case of this embodiment, the lower ends of the front wall 81 and the left side wall 82 constituting the cooling duct 8 are extended to the position of the center position X of the compressor body 2 and have a horizontal shape, and the lower ends of the right side wall 83 and the rear wall 84 are configured so that they are placed at a position above the compressor body 2 and have a horizontal shape.

(Explanation of Action)

Next, the action of the package-type air-cooled screw compressor according to Embodiment 1 configured as described above will be explained.

In the package-type air-cooled screw compressor, by the operation of the cooling fan 3A attached to the drive motor 3 and the propeller fan 9, the air outside the package 1 is taken in from the first intake opening 5 and the second intake opening 6 as cooling air and air for compression. Although the air taken in from the first intake opening 5 flows from the upper section of the left side plate 1A to the compressor body 2, since the air intake port 2A is provided in the middle of the passage, the air is sucked into the compressor body 2 as air for compression before being heated by the heat from the outer surface of the casing 23 of the compressor body 2. Furthermore, the air having flowed toward the compressor body 2 is sucked into the cooling duct 8 while being along the outer peripheries of the compressor body 2 and the gear box 4 as cooling air. On the other hand, the air sucked in from the second intake opening 6 flows mainly along the outer periphery of the drive motor 3 by the action of the cooling fan 3A and is sucked into the cooling duct 8. The cooling air having entered the cooling duct 8 cools the compressed air and the lubricant oil in the heat exchanger 10 and is exhausted from the exhaust opening 7 to the outside of the package 1.

Next, the feature of this embodiment, that is, the suppression of noise leakage from the exhaust opening 7, more particularly, the suppression of noise leakage in the compressor body 2, will be explained.

As illustrated in FIG. 1 and FIG. 2*a,* in this embodiment, as a countermeasure for noise leakage from the exhaust opening 7, the lower ends of the hanging wall faces constituting the cooling duct 8 are extended downward so that the lower-end inlet 8A of the cooling duct 8 is not viewable from the center position X of the compressor body 2. More specifically, out of the hanging wall faces constituting the cooling duct 8, the front wall 81 and the left side wall 82 facing the compressor body 2 are extended to a position equivalent to the center position X or a position slightly lower than the center position X of the compressor body 2, and the lower ends of the right side wall 83 and the rear wall 84 are placed at height positions similar to a conventional one.

With this configuration, as illustrated in FIG. 2*a,* the noise emitted from the portion of the casing 23 above the center position X of the compressor body 2 is insulated by the front wall 81 and the left side wall 82 facing the compressor body 2. Hence, the noise emitted from the portion of the casing 23 above the center position X of the compressor body 2 is diffracted and attenuated and then propagated into the cooling duct 8. As a result, the noise leakage from the exhaust opening 7 is suppressed.

Figure 2B:
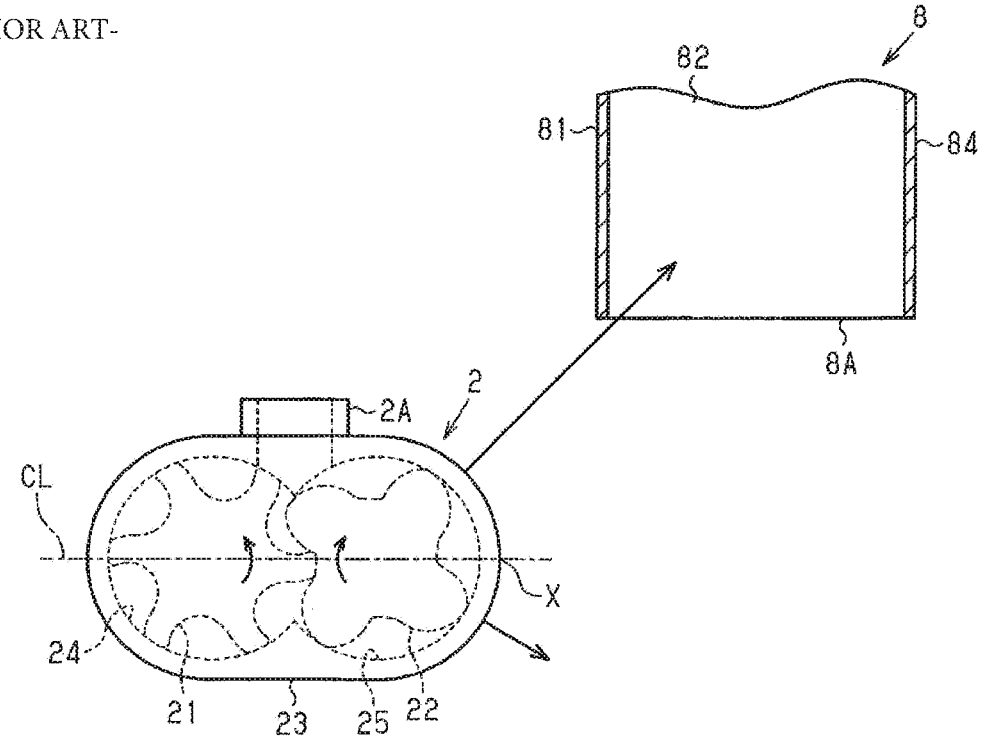
FIG. 2*b* is a schematic view illustrating the positional relationship between the compressor body and the cooling duct in a conventional example.

On the other hand, as illustrated in FIG. 2*b,* in the case that the front wall 81 and the left side wall 82 facing the compressor body 2 are placed at the position above the compressor body 2 as in a conventional one, the lower-end inlet 8A of the cooling duct 8 is placed at the position viewable from the portion of the casing 23 above the center position X of the compressor body 2. Hence, the noise emitted from the portion of the casing 23 above the center position X of the compressor body 2 is liable to be propagated into the cooling duct 8. Accordingly, in the case of this embodiment, the leakage of the noise emitted from the compressor body 2 can be suppressed in comparison with a conventional one.

Furthermore, in the case of this embodiment, since the lower end of the front wall 81 facing the gear box 4 is extended to the center of the gear box 4 in the up-down direction in many cases, the propagation of the noise emitted from the gear box 4 to the cooling duct 8 is also suppressed. Hence, from this point, the noise leakage is also suppressed.

Furthermore, although the compressor body 2 has the air intake port 2A for compressed air, since the air intake port 2A is provided at the upper section of the compressor body 2, the lower-end inlet 8A of the cooling duct 8 is not viewable from the air intake port 2A. Moreover, although the noise generated inside the compressor body 2 leaks from the air intake port 2A, since the front wall 81 and the left side wall 82 are extended downward, the noise is diffracted and attenuated and then propagated to the cooling duct 8. Hence, the noise inside the compressor leaking from the air intake port 2A is suppressed from leaking from the exhaust opening 7.

Since the noise emitted from the drive motor 3 is smaller than that of the noise of the compressor body 2, no special consideration is given thereto in this embodiment. Hence, out of the hanging wall faces of the cooling duct 8, the right side wall 83 facing the drive motor 3 is placed at a height position similar to a conventional one.

On the other hand, for the suppression of noise leakage at the intake openings, a soundproof plate 5A and a soundproof plate 6A are conventionally provided for the first intake opening 5 and the second intake opening 6 so as to be opposed to the openings with a slight clearance provided therebetween, whereby the noise directed toward the first intake opening 5 and the second intake opening 6 is insulated effectively. Hence, the suppression of the noise leakage at the intake openings in this embodiment is the same as that in a conventional one.

Next, the cooling action by the cooling air in this embodiment will be explained. As described above, the cooling air taken in from the first intake opening 5 flows from above the left plate 1A to the compressor body 2 via the circumference of the air intake port 2A. In this case, since the lower ends of the front wall 81 and the left side wall 82 of the cooling duct 8 are extended to the center position X of the compressor body 2, the cooling air flowing along the outer peripheries of the compressor body 2 and the gear box 4 also flows easily along the lower sections of the compressor body 2 and the gear box 4. In the case that the lower ends of the front wall 81 and the left side wall 82 of the cooling duct 8 are placed at height positions similar to the lower ends of the right side wall 83 and the rear wall 84 (see FIG. 2*b*), the air flow tends to deviate to the upper section of the compressor body 2; however, since the lower ends of the front wall 81 and the left side wall 82 are extended downward as described above, this problem is improved. As a result, the effect of cooling the compressor body 2 and the gear box 4 is also improved.

On the other hand, the air sucked in from the second intake opening 6 flows mainly along the outer periphery of the drive motor 3 by the action of the cooling fan 3A. Also in this case, since the lower end of the front wall 81 is extended downward as described above, the deviation of the air flow to the upper section of the drive motor 3 is improved. Hence, the effect of cooling the drive motor 3 is also improved.

(Description of Effect)

The package-type air-cooled screw compressor according to Embodiment 1 configured as described above exhibits the following effects.

(1) Since the lower ends of the hanging wall faces constituting the cooling duct 8, more particularly, the lower ends of the front wall 81 and the left side wall 82, are extended downward so that the lower-end inlet 8A of the cooling duct 8 is placed at a position not viewable from the center position X of the compressor body 2, the noise emitted from the portion of the casing 23 above the center position X of the compressor body 2 can be suppressed from leaking from the exhaust opening 7.

(2) Since the compressor body 2 and the drive motor 3 are connected uniaxially via the gear box 4 and disposed in the bottom section of the package 1, the main heavy devices are disposed in the bottom section of the package 1; as a result, the package 1 can be formed into a simple structure.

(3) Furthermore, since the lower end of the front wall 81 is extended downward in this case, the lower-end inlet 8A of the cooling duct 8 is not viewable also from the nearly upper half portion of the gear box 4, whereby the noise from the gear box 4 can be suppressed from leaking from the exhaust opening 7.

(4) Since the lower-end inlet 8A of the cooling duct 8 is placed at a position not viewable from the air intake port 2A of the compressor body 2, the noise inside the compressor leaking from the air intake port 2A can be suppressed from leaking from the exhaust opening 7.

(5) Since the lower ends of the front wall 81 and the left side wall 82 are extended downward, the amount of the air flowing to the lower sections of the compressor body 2, the gear box 4 and the drive motor 3 increases, whereby the effect of cooling these devices can be improved.

(6) The first intake opening 5 is provided as an intake opening for mainly taking in the cooling air for the compressor body 2. In addition, since the air intake port 2A is positioned in the middle of the flow of the cooling air flowing from the first intake opening 5 to the compressor body 2, the temperature of the intake air of the compressor body 2 is lowered, and the intake efficiency of the compressor can be raised.

(7) Furthermore, since the first intake opening 5 is disposed above the air intake port 2A and the casing 23 of the compressor body 2, the air from the first intake opening 5 is further relieved from being heated by the compressor body 2.

Embodiment 2

Next, Embodiment 2 will be described on the basis of FIG. 3*a* to FIG. 3*d*.

In Embodiment 2, the lower ends of the front wall 81 and the left side wall 82 of the hanging wall faces constituting the cooling duct 8 in Embodiment 1 are changed. In Embodiment 2, the same components as those in Embodiment 1 are designated by the same reference signs and their descriptions are omitted. This point is similarly applicable to the descriptions of Embodiment 3 and the following embodiments.

Figure 3A:
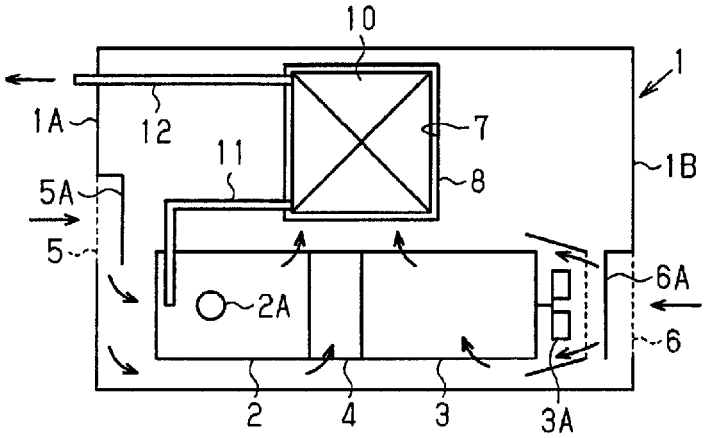
FIG. 3*a* is a schematic view explaining a configuration of a package-type air-cooled screw compressor according to Embodiment 2 and is a plan view thereof.
Figure 3B:
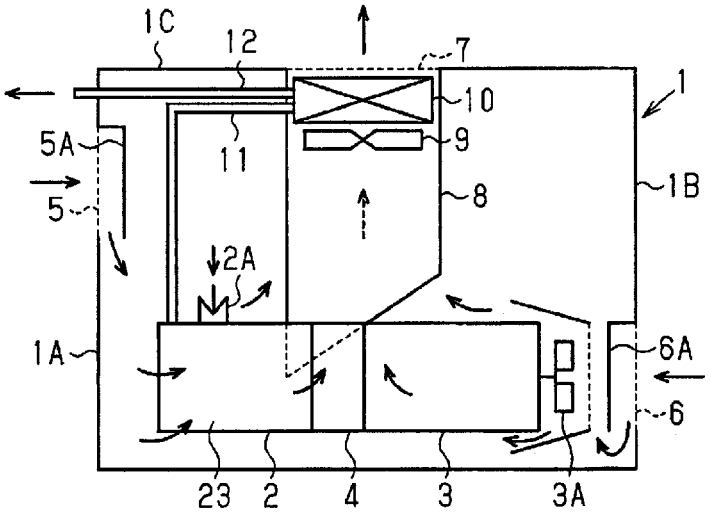
FIG. 3*b* is a front view of the screw compressor of FIG. 3*a*.
Figure 3C:
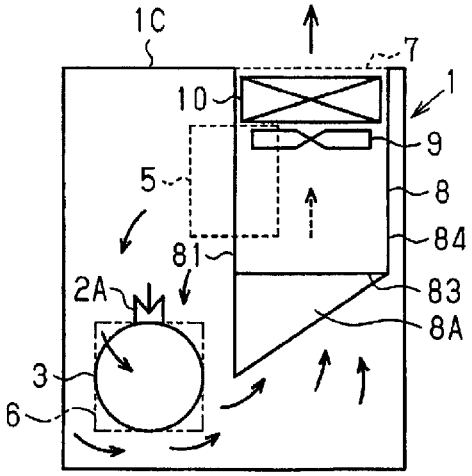
FIG. 3*c* is a right side view of the screw compressor of FIG. 3*a*.
Figure 3D:
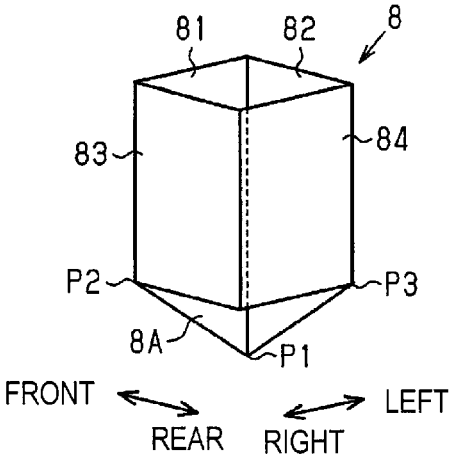
FIG. 3*d* is a perspective view of the cooling duct of FIG. 3*a*.

In other words, as illustrated in FIG. 3*d*, the lowest point P1 of the corner sections of the front wall 81 and the left side wall 82 is the same as in the case of Embodiment 1. Furthermore, the lower end of the front wall 81 is formed as an inclined side into a shape rising from the lowest point P1 to the lower end point P2 on the front side of the right side wall 83. Moreover, the lower end of the left side wall 82 is formed as an inclined side into a shape rising from the lowest point P1 to the lower end point P3 on the left side of the rear wall 84. In this case, the inclined sides constituting the lower ends of the front wall 81 and the left side wall 82 are inclined so that the lower-end inlet 8A of the cooling duct 8 is not viewable from the center position X of the compressor body 2.

In Embodiment 2, since the cooling duct 8 is configured as described above, with respect to the action for suppressing noise leakage, the leakage suppressing actions from the exhaust opening 7 due to the noise emitted from the casing 23 of the compressor body 2 and the noise inside the compressor emitted from the air intake port 2A of the compressor body 2 are the same. Furthermore, as can be seen from FIG. 3*b*, with respect to the leakage suppressing action from the exhaust opening 7 due to the noise emitted from the gear box 4, propagation suppression to the cooling duct 8 is slightly inferior to that in Embodiment 1 because the lower end of the front wall 81 is formed as an inclined side rising to the right. However, this difference does not cause a significant change in the effect of suppressing the noise leakage because the noise emitted from the gear box 4 is smaller than the noise emitted from the casing 23 of the compressor body 2 and the air intake port 2A.

On the other hand, with respect to the cooling action by the cooling air, since the lower ends of the front wall 81 and the left side wall 82 are inclined from the lowest point P1 to the lower end point P2 of the right side wall or to the lower end point P3 of the rear wall 84, an increase in the amount of wind due to the decrease in the passage resistance of the cooling air is expected. On the other hand, the cooling air is liable to flow to the upper section sides of the compressor body 2 and the gear box 4, whereby the cooling effect for the lower sections may be adversely affected to some degree. However, it is assumed that there is no large difference as a whole in comparison with the case in Embodiment 1.

Accordingly, although Embodiment 2 is slightly inferior in the effects in items (3) and (5) in Embodiment 1, it can exhibit similar effects with respect to the other effects in items (1), (2), (4), (6), and (7).

Embodiment 3

Next, Embodiment 3 will be described on the basis of FIG. 4*a* to FIG. 4*d*.

Embodiment 3 is different from Embodiment 1 in the position of the exhaust opening 7; since the cooling duct 8 is disposed so as not to be extended directly downward from the exhaust opening 7, the hanging wall faces of the cooling duct 8 are changed so as to conform to this disposition condition.

Figure 4A:
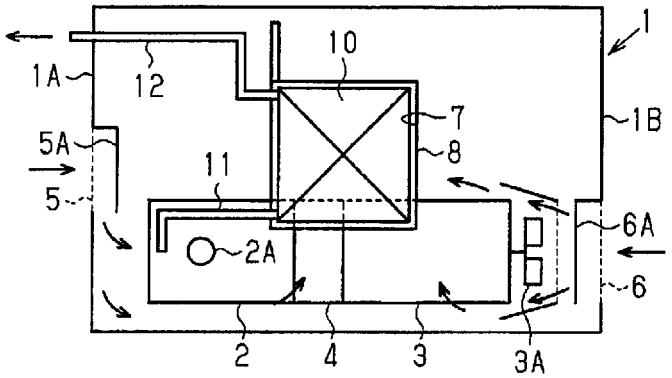
FIG. 4*a* is a schematic view explaining a configuration of a package-type air-cooled screw compressor according to Embodiment 3 and is a plan view thereof.
Figure 4B:
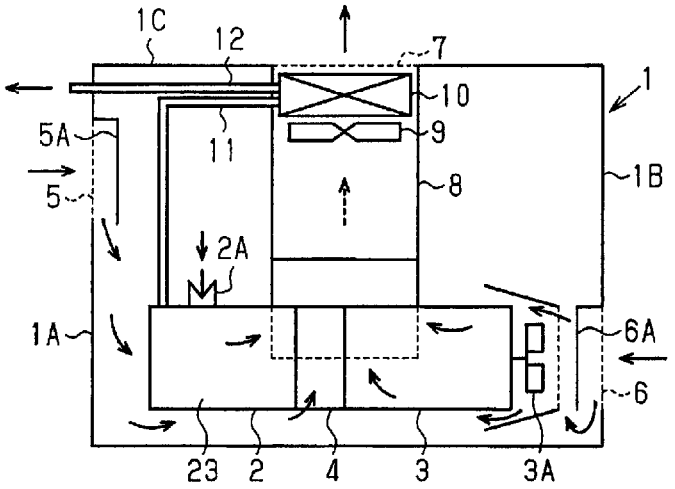
FIG. 4*b* is a front view of the screw compressor of FIG. 4*a*.
Figure 4C:
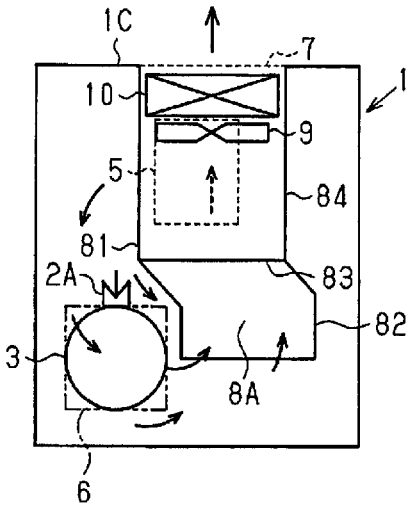
FIG. 4*c* is a right side view of the screw compressor of FIG. 4*a*.
Figure 4D:
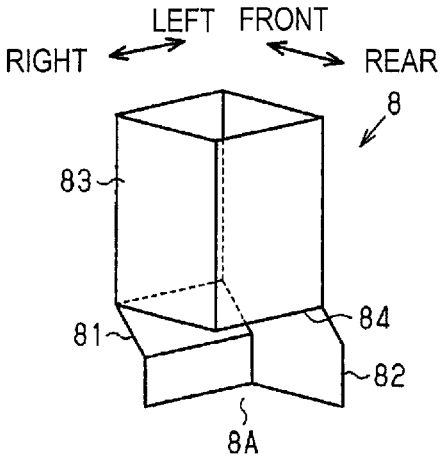
FIG. 4*d* is a perspective view of the cooling duct of FIG. 4*a*.

As can be fully seen from FIG. 4*a* to FIG. 4*c*, in this embodiment, since the exhaust opening 7 is formed in the center section of the top plate 1C in the front-rear direction, if made to hang directly downward, the lower sections of the front wall 81 and the left side wall 82 of the cooling duct 8 interfere with the compressor body 2, the gear box 4 and the drive motor 3. Hence, in Embodiment 3, the lower section of the cooling duct 8 is bent to the rear side of the compressor body 2 and the like to avoid this interference.

Also in this case, the lower ends of the front wall 81 and the left side wall 82 of the cooling duct 8 are extended so that the lower-end inlet 8A of the cooling duct 8 is not viewable from the center position X of the compressor body 2. More specifically, as can be fully seen from FIG. 4*d*, the lower section of the front wall 81 is formed into a shape so as to be bent to the rear side at the portion above the compressor body 2 and to be extended directly downward on the rear side of the compressor body 2. In addition, the left side wall 82 is formed into a planar shape distorted in accordance with the bent shape of the front wall 81. The height position at which the front wall 81 and the left side wall 82 shift toward the rear side is aligned with the lower ends of the right side wall 83 and the rear wall 84.

Since Embodiment 3 is configured as described above, the leakage suppressing action for the noise from the exhaust opening 7 and the cooling action by the cooling air in the compressor body 2, the drive motor 3 and the gear box 4 are similar to those in Embodiment 1. Hence, Embodiment 3 can exhibit the effects in items (1) to (7) in Embodiment 1.

Embodiment 4

Next, Embodiment 4 will be described on the basis of FIG. 5*a* to FIG. 5*d*.

Embodiment 4 is obtained by modifying Embodiment 1 so that a part of the hanging walls constituting the cooling duct 8 is changed so as to be used in common with the package 1.

Figure 5A:
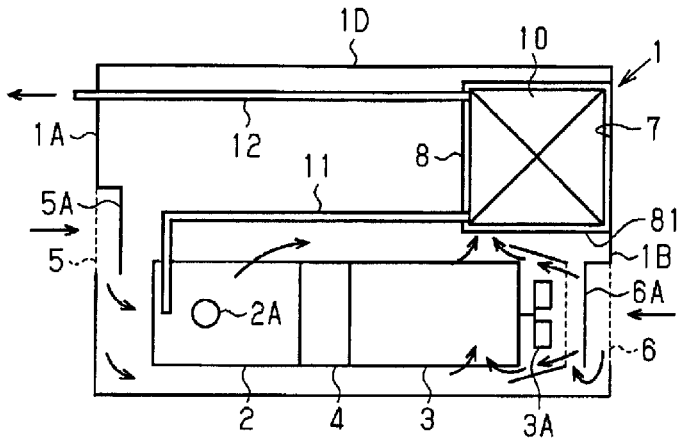
FIG. 5*a* is a schematic plan view explaining a configuration of a package-type air-cooled screw compressor according to Embodiment 4 and is a plan view thereof.
Figure 5B:
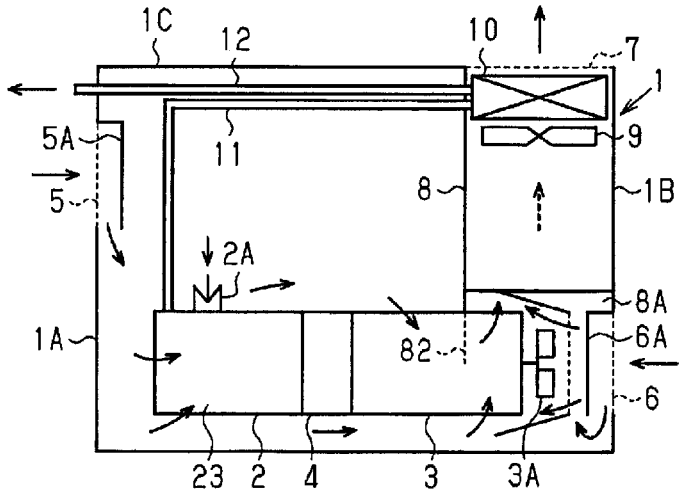
FIG. 5*b* is a front view of the screw compressor of FIG. 5*a*.
Figure 5C:
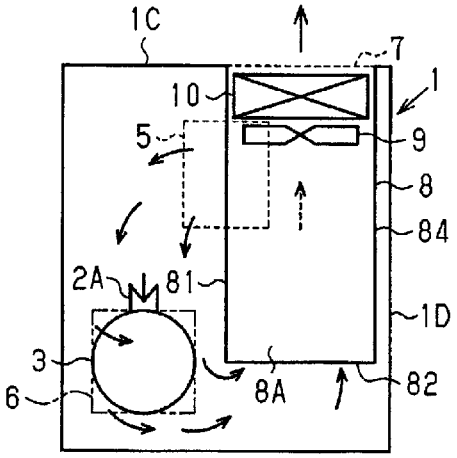
FIG. 5*c* is a right side view of the screw compressor of FIG. 5*a*.
Figure 5D:
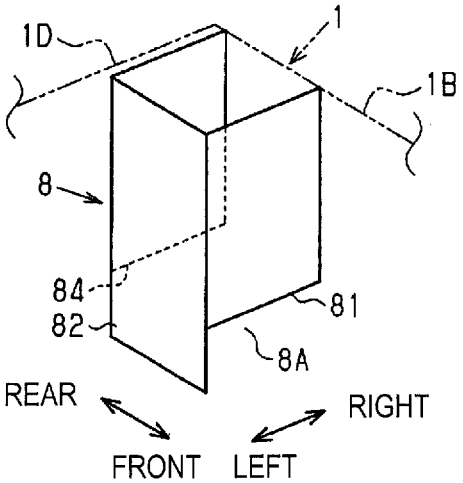
FIG. 5*d* is a perspective view of the cooling duct of FIG. 5*a*.

More specifically, as can be fully seen from FIG. 5*a* to FIG. 5*c*, the cooling duct 8 is formed at a position making contact with the right side plate 1B of the package 1 by moving the exhaust opening 7 to the right rear corner section. Hence, the right side wall of the cooling duct 8 is used in common as the right side plate 1B of the package 1. As can be fully seen from FIG. 5*d*, although the rear wall 84 is disposed close to the rear plate 1D of the package 1, it is not used in common as the rear plate 1D of the package 1 in this embodiment.

Furthermore, in the case that the cooling duct 8 is moved to the right rear corner section as described above, the front wall 81 of the hanging wall faces constituting the cooling duct 8 is located at a position significantly away from the compressor body 2. Hence, unlike the case of Embodiment 1, only the left side wall 82 is extended downward to the center position X (see FIG. 2*a*) of the compressor body 2 so that the lower-end inlet 8A of the cooling duct 8 is not viewable from the casing 23 above the compressor body 2.

Since Embodiment 4 is configured as described above, the leakage suppressing action for the noise from the exhaust opening 7 and the cooling action by the cooling air in the compressor body 2 and the gear box 4 are similar to those in Embodiment 1. However, as for the drive motor 3, since the front wall 81 has similar lower end position to that of a conventional one as the rear wall 84, the leakage suppressing action for the noise from the exhaust opening 7 and the cooling action by the cooling air in the drive motor 3 are not improved. In this respect, this is different from Embodiment 1.

Hence, Embodiment 4 can exhibit the effects in items (1) to (4), (6) and (7) in Embodiment 1 and can also exhibit the following effect.

(8) Since the right side wall 83 of the cooling duct 8 is used in common as the right side plate 1B of the package 1, the material cost of the cooling duct 8 can be saved.

Embodiment 5

Next, Embodiment 5 will be described on the basis of FIG. 6*a* to FIG. 6*d*.

Embodiment 5 is obtained by modifying Embodiment 1 so that a part of the hanging wall faces constituting the cooling duct 8 does not interfere at the lower portion with the compressor body 2 due to the difference in the position of the exhaust opening 7 and so that a part of the hanging wall faces is used in common with the package 1.

Figure 6A:
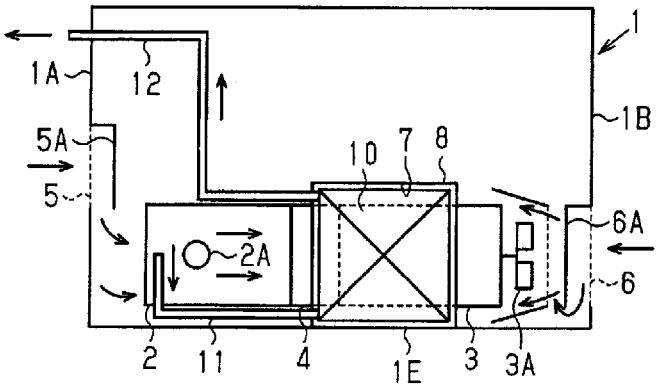
FIG. 6*a* is a schematic view explaining a configuration of a package-type air-cooled screw compressor according to Embodiment 5 and is a plan view thereof.
Figure 6B:
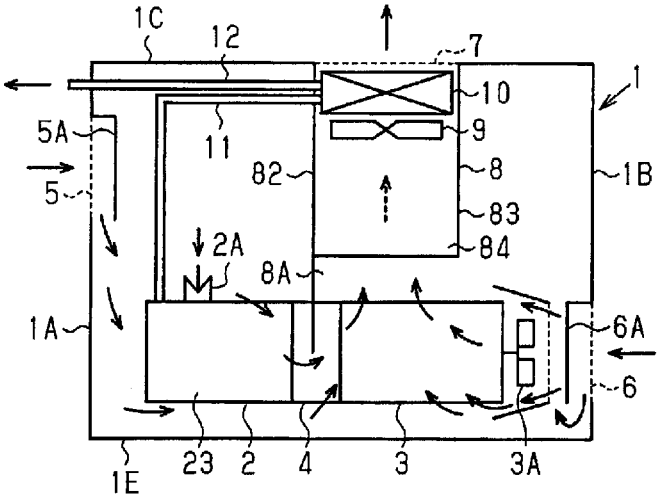
FIG. 6*b* is a front view of the screw compressor of FIG. 6*a*.
Figure 6C:
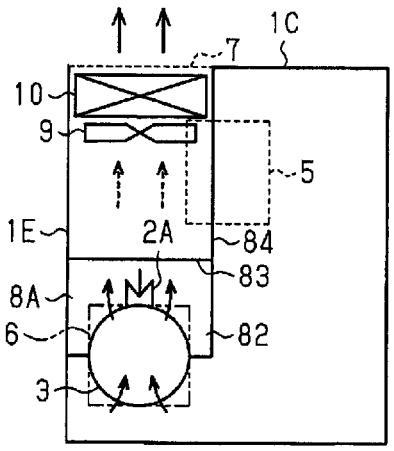
FIG. 6*c* is a right side view of the screw compressor of FIG. 6*a*.
Figure 6D:
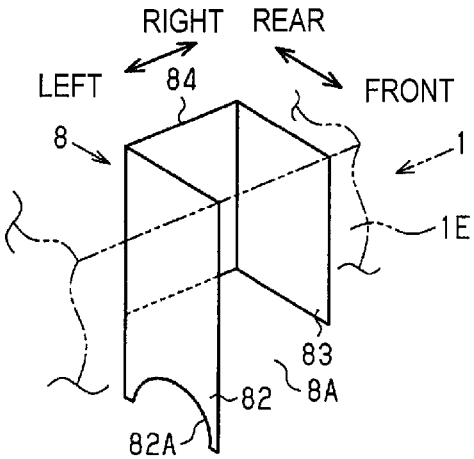
FIG. 6*d* is a perspective view of the cooling duct of FIG. 6*a*.

As can be fully seen from FIG. 6*a* to FIG. 6*c*, in this embodiment, the exhaust opening 7 is formed in the top plate 1C at a slightly rightward position in the left-right direction and at a position making contact with the front wall.

Hence, as can be seen from FIG. 6*a* to FIG. 6*d*, in this embodiment, the left side wall 82 of the hanging wall faces constituting the cooling duct 8 is extended downward so that the lower-end inlet 8A of the cooling duct 8 is not viewable from the center position X (see FIG. 2*a*) of the compressor body 2. Furthermore, as can be fully seen from FIG. 6*d*, the lower section of the left side wall 82 is provided with a semicircular arc cutout section 82A to prevent interference with the gear box 4. Although the circular arc shape is taken as an example in this embodiment, since the cutout section 82A is desired to make close contact with the outer surface of the upper half section of the gear box 4, it desirably has a shape conforming to the outer surface shape of the upper half section of the gear box 4.

Furthermore, since the cooling duct 8 is formed at a position making contact with the front plate 1E of the package 1, the horizontal cross-sectional shape thereof is formed into a groove shape being open forward, and the front wall of the cooling duct 8 is used in common as the front plate 1E of the package 1.

Since Embodiment 5 is configured as described above, the leakage suppressing action for the noise from the exhaust opening 7 and the cooling action by the cooling air in the compressor body 2 are similar to those in Embodiment 1.

However, as can be seen from FIG. 6*a* to FIG. 6*c,* since the gear box 4 and the drive motor 3 are positioned below the lower-end inlet 8A of the cooling duct 8, such improvement as in Embodiment 1 is not expected with respect to the leakage suppressing action for the noise from the exhaust opening 7 and the cooling action by the cooling air in the gear box 4 and the drive motor 3.

Hence, Embodiment 5 can exhibit the effects in items (1), (2), (4), (6), and (7) in Embodiment 1 and can also exhibit the following effect.

(9) Since the front wall of the cooling duct 8 is used in common as the front plate 1E of the package 1, the material cost of the cooling duct 8 can be saved.

Embodiment 6

Next, Embodiment 6 will be described on the basis of FIG. 7*a* to FIG. 7*d.*

Figure 7A:
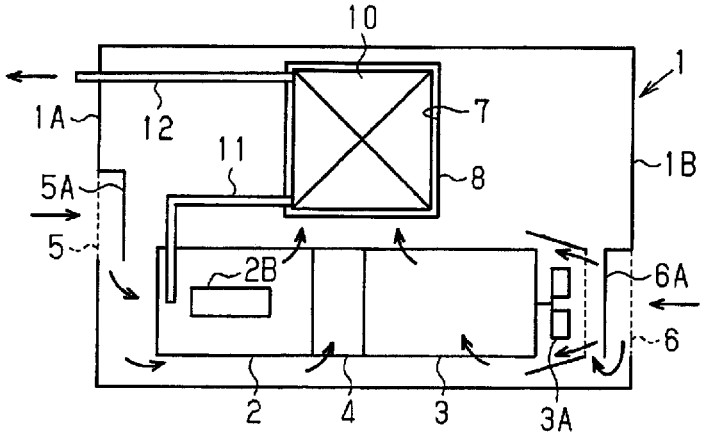
FIG. 7*a* is a schematic view explaining a configuration of a package-type air-cooled screw compressor according to Embodiment 6 and is a plan view thereof.
Figure 7B:
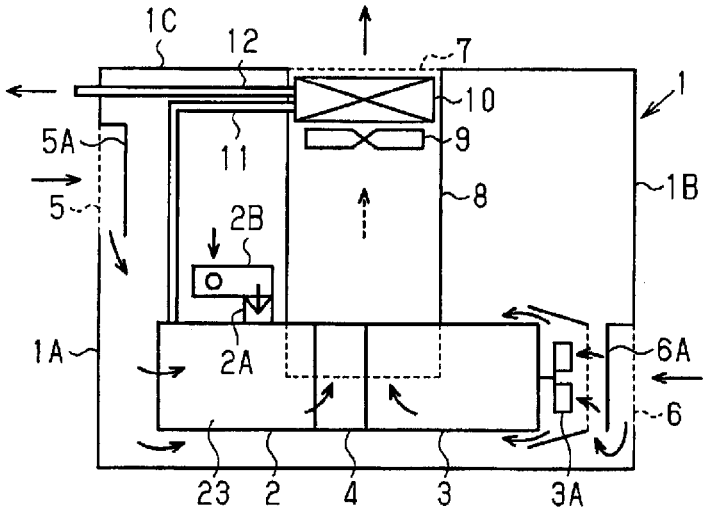
FIG. 7*b* is a front view of the screw compressor of FIG. 7*a*.
Figure 7C:
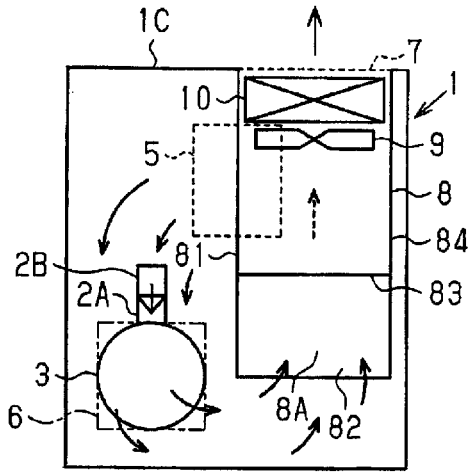
FIG. 7*c* is a right side view of the screw compressor of FIG. 7*a*.
Figure 7D:
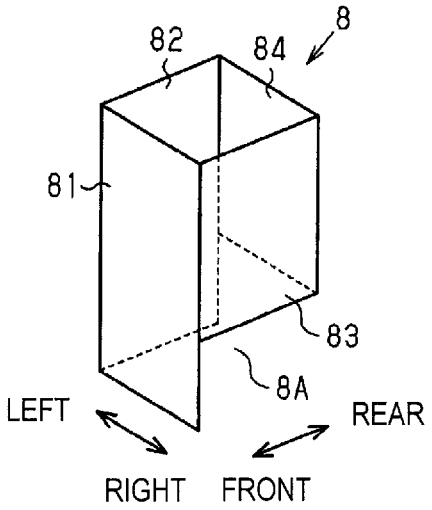
FIG. 7*d* is a perspective view of the cooling duct of FIG. 7*a*.

As illustrated in FIG. 7*a* to FIG. 7*c,* Embodiment 6 is obtained by providing an intake filter 2B to the air intake port 2A of the compressor body 2 in Embodiment 1. Hence, as illustrated in FIG. 7*d,* since the shape of the cooling duct 8 is the same as that in Embodiment 1 and since this embodiment is the same as Embodiment 1 except that the intake filter 2B is provided, the lower-end inlet 8A of the cooling duct 8 is not viewable from the intake filter 2B.

As in the case of Embodiment 1 in which the intake filter 2B is not installed, the noise generated inside the compressor body 2 leaks from the intake filter 2B installed on the air intake port 2A: however, since the front wall 81 and the left side wall 82 are extended downward, the noise is diffracted and attenuated and then propagated to the cooling duct 8. Hence, the noise inside the compressor leaking from the intake filter 2B installed on the air intake port 2A is suppressed from leaking from the exhaust opening 7.

Since Embodiment 6 is configured as described above, the leakage suppressing action for the noise from the exhaust opening 7 and the cooling action by the cooling air in the compressor body 2, the drive motor 3 and the gear box 4 are similar to those in Embodiment 1. Hence, Embodiment 6 can exhibit the effects in items (1) to (7) in Embodiment 1.

Embodiment 7

Next, Embodiment 7 will be described on the basis of FIG. 8*a* to FIG. 8*d.*

Embodiment 7 is obtained by modifying Embodiment 1 so that the lower ends of the right side wall 83 and the rear wall 84 of the hanging wall faces constituting the cooling duct 8 are changed.

Figure 8A:
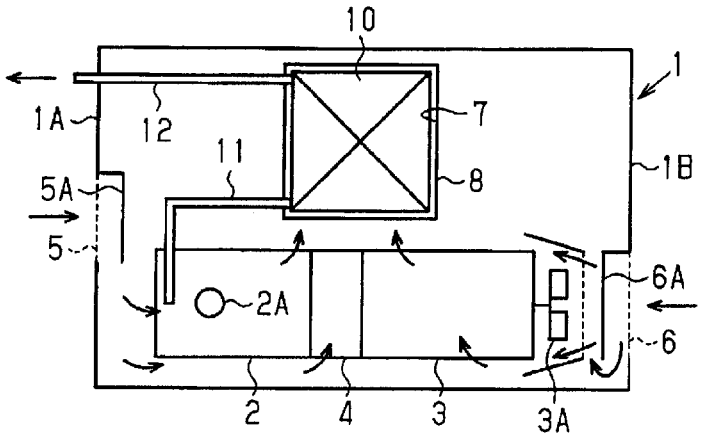
FIG. 8*a* is a schematic view explaining a configuration of a package-type air-cooled screw compressor according to Embodiment 7 and is a plan view thereof.
Figure 8B:
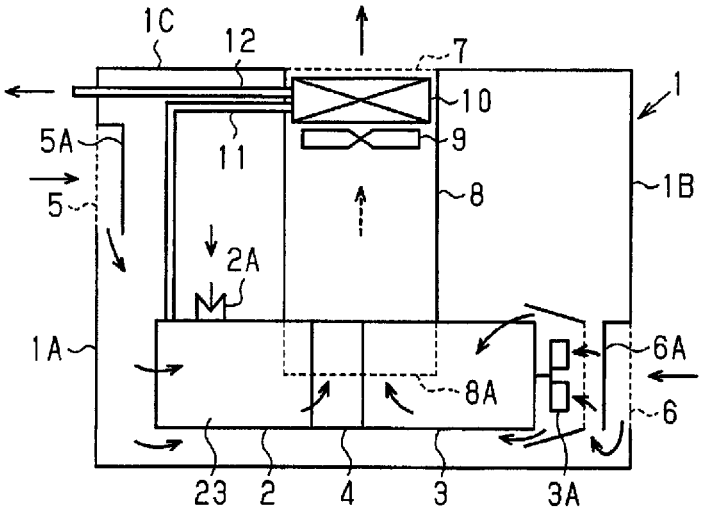
FIG. 8*b* is a front view of the screw compressor of FIG. 8*a*.
Figure 8C:
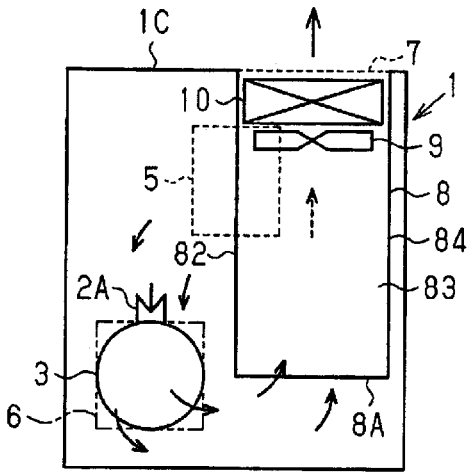
FIG. 8*c* is a right side view of the screw compressor of FIG. 8*a*.
Figure 8D:
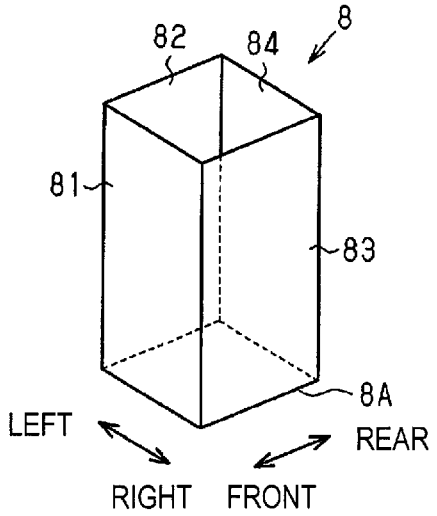
FIG. 8*d* is a perspective view of the cooling duct of FIG. 8*a*.
Figure 9A:
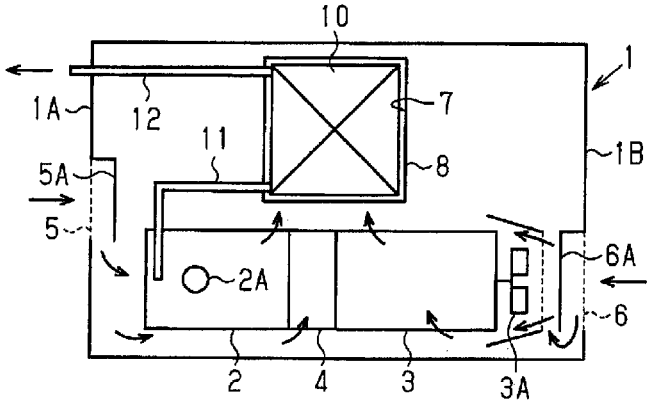
FIG. 9*a* is a schematic view explaining a configuration of a package-type air-cooled screw compressor according to Embodiment 8 and is a plan view thereof.
Figure 9B:
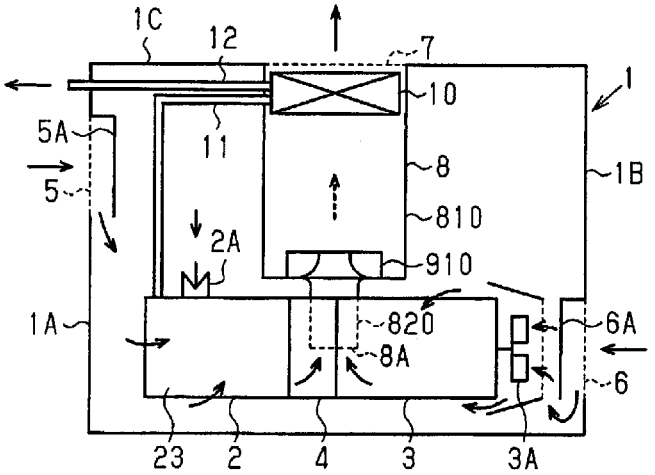
FIG. 9*b* is a front view of the screw compressor of FIG. 9*a*.
Figure 9C:
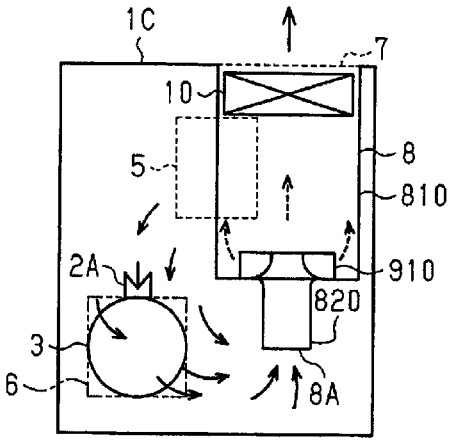
FIG. 9*c* is a right side view of the screw compressor of FIG. 9*a*.
Figure 9D:
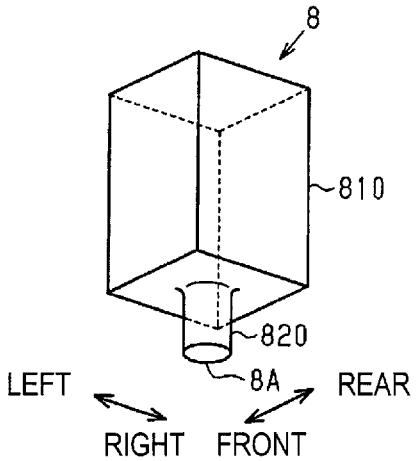
FIG. 9*d* is a perspective view of the cooling duct of FIG. 9*a*.
Figure 10A:
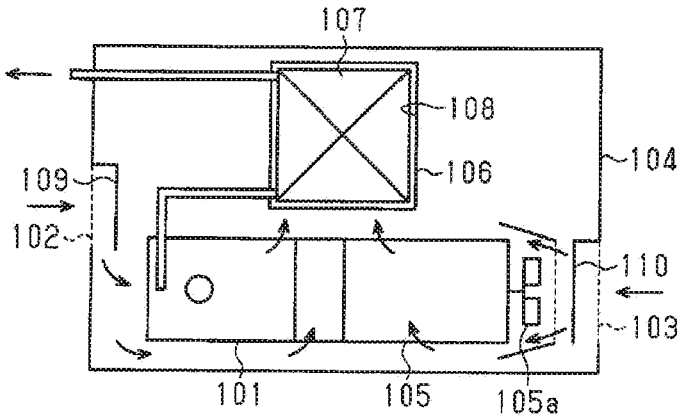
FIG. 10*a* is a schematic view explaining a configuration of a conventional package-type air-cooled screw compressor and is a plan view thereof.
Figure 10B:
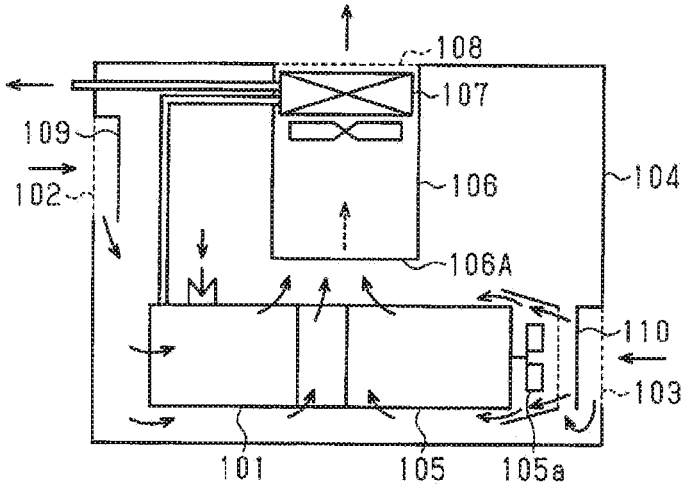
FIG. 10*b* is a front view of the screw compressor of FIG. 10*a*.
Figure 10C:
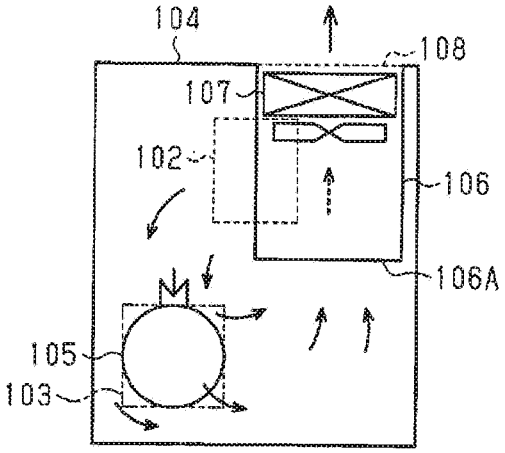
FIG. 10*c* is a right side view of the screw compressor of FIG. 10*a*.
Figure 10D:
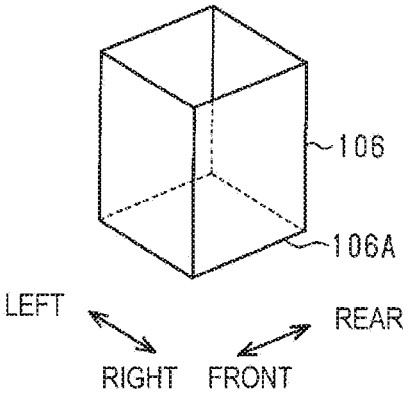
FIG. 10*d* is a perspective view of the cooling duct of FIG. 10*a*.

In other words, as illustrated in FIG. 8*d,* in this embodiment, the lower ends of the right side wall 83 and the rear wall 84 are made the same as those of the lower ends of the front wall 81 and the left side wall 82. Hence, the lower ends of each of the hanging wall faces constituting the cooling duct 8 are the same, and are all formed as horizontal sides. Hence, as in the case of Embodiment 1, the lower-end inlet 8A of the cooling duct 8 is not viewable from the center position X (see FIG. 2*a*) of the compressor body 2.

In this case, like the center position X of the compressor body 2, when the horizontal plane position passing through the center axis on the casing surface of the drive motor 3 and serving as the position of the surface of the motor casing close to the cooling duct 8 is defined as "the center position of the drive motor 3", it is possible to mention the following.

In this embodiment, since the compressor body 2 and the drive motor 3 are connected in a single axial direction, the center positions of both are scarcely displaced significantly. In this embodiment, setting is made so that the lower-end inlet 8A of the cooling duct 8 is not viewable from the center position X of the compressor body 2, and the lower-end inlet 8A of the cooling duct 8 is thus not viewable from the most portions of the casing above the center position of the drive motor 3. Furthermore, in this case, the lower-end inlet 8A of the cooling duct 8 is not viewable from the nearly upper half section of the case of the gear box 4 that connects the compressor body 2 and the drive motor 3.

Moreover, the drive motor 3 generally has a nearly cylindrical casing. Hence, the portion of the casing below the center position (as high as the center axis of the drive motor 3 in this case) of the drive motor 3 is formed into a circular arc shape protruding downward, whereby the noise emitted from the portion of the casing below the center position is directed downward as in the case of the compressor body 2. Therefore, the portion of the casing below the center position of the drive motor 3 originally does not have a positional relationship capable of viewing the cooling duct 8. Further, the portion of the casing above the center position of the drive motor 3 mostly has a relationship incapable of viewing the lower-end inlet 8A. Hence, the noise emitted from the drive motor 3 is mostly diffracted and attenuated and then propagated to the cooling duct 8. In addition, with respect to the noise emitted from the gear box 4, the noise emitted from the upper section of the case is also diffracted and attenuated by the noise insulating effect of the cooling duct 8 and then propagated to the cooling duct 8.

Since Embodiment 7 is configured as described above, as in the case of Embodiment 1, with respect to the action for suppressing noise leakage, the noise emitted from the casing 23 of the compressor body 2 and the noise inside the compressor being emitted from the air intake port 2A of the compressor body 2 are suppressed from leaking from the exhaust opening 7. Still further, in this embodiment, the noise emitted from the drive motor 3 and the gear box 4 is also suppressed from leaking from the exhaust opening 7.

On the other hand, with respect to the cooling action by the cooling air, since not only the lower ends of the front wall 81 and the left side wall 82 but also those of the right side wall 83 and the rear wall 84 are extended downward at least to the center position X of the compressor body 2, the air flow passing through the peripheries of the compressor body 2, the gear box 4 and the drive motor 3 is liable to pass downward.

Accordingly, Embodiment 7 can exhibit the effects in items (1) to (7) in Embodiment 1 and can also exhibit the following effects.

(10) In this embodiment, since the noise emitted from the drive motor 3 and the gear box 4 is also suppressed from leaking from the exhaust opening 7, the noise leakage from the exhaust opening 7 is further improved.

(11) Since the amount of the flow passing through the lower peripheral sections of the compressor body 2, the gear box 4 and the drive motor 3 increases, the cooling effect by the cooling air in the compressor body 2, the gear box 4 and the drive motor 3 is improved. Hence, the flowing amount of the cooling air can be reduced in comparison with the case of Embodiment 1. Furthermore, since this makes it possible to decrease the opening areas of the exhaust opening 7 and the first intake opening 5 and the second intake opening 6 serving as the intake openings, the leakage of the noise can be suppressed. Moreover, since the flowing amount of the cooling air can be reduced, the cooling fan can be operated at low speed, whereby the leakage of the noise can be reduced.

Embodiment 8

Next, Embodiment 8 will be described on the basis of FIG. 9*a* to FIG. 9*d*.

Embodiment 8 is obtained by modifying Embodiment 7 so that the configurations of the exhaust fan and the cooling duct 8 are changed.

In other words, as illustrated in FIG. 9*a* to FIG. 9*d*, a turbo fan 910 is used as an exhaust fan in this embodiment. Furthermore, the cooling duct 8 is composed of an exhaust duct 810 that makes the blowing side of the turbo fan 910 to communicate with the exhaust opening 7 and an intake duct 820 provided on the intake side of the turbo fan 910.

The exhaust duct 810 has a square cross-sectional shape and has a cross-sectional area having the size equivalent to that in the case of Embodiment 1. In addition, inside the exhaust duct 810, the heat exchanger 10 is disposed in the vicinity of the exhaust opening 7 so as to close the exhaust opening 7 as in the case of Embodiment 1.

On the other hand, the intake duct 820 is formed into a circular duct having a cross-sectional area smaller than that of the exhaust duct 810. Furthermore, the inlet at the lower end of the intake duct 820 forms the lower-end inlet 8A of the cooling duct 8 and is formed so as to be positioned below the center position X of the compressor body 2. The cross-sectional area of the intake duct 820 can be made small as described above on the basis of the characteristics of the turbo fan 910.

Since Embodiment 8 is configured as described above, the lower-end inlet 8A of the cooling duct 8 is not viewable from the center position X of the compressor body 2 as in the case of Embodiment 7. Furthermore, although the relationship with the center position of the drive motor 3 changes depending on the circumstances of the connection via the gear box 4, a positional relationship is set such that the lower-end inlet 8A of the cooling duct 8 is not findable at least from the most portions of the casing above the center position of the drive motor 3 and the most portions of the case above the gear box 4. Hence, the noise emitted from the compressor body 2 is entirely diffracted and attenuated and then propagated to the cooling duct. Moreover, the noise emitted from the drive motor 3 and the gear box 4 is mostly diffracted and attenuated and then propagated to the cooling duct 8. Hence, the noise to be propagated to the cooling duct 8 is suppressed. Further, since the cross-sectional area of the intake port of the intake duct 820 constituting the lower-end inlet 8A of the cooling duct 8 is smaller than the cross-sectional area of the lower-end inlet 8A (intake port) for the propeller fan as illustrated in Embodiment 7, the effect of diffraction and attenuation is greater than that in the case of Embodiment 7.

Furthermore, with respect to the cooling action by the cooling air in the compressor body 2, the gear box 4 and the drive motor 3, since the intake duct 820 having a small cross-sectional area is extended downward at least to the center position X of the compressor body 2, the air flow passing through the peripheries of the compressor body 2, the gear box 4 and the drive motor 3 is liable to pass downward.

Accordingly, Embodiment 8 can exhibit the effects in items (1) to (7) in Embodiment 1. Furthermore, it can also exhibit the effects in items (10) and (11) in Embodiment 7. Moreover, the effect in item (10) is further improved in comparison with the case of Embodiment 7.

[Modification]

The above-mentioned embodiments can be changed as described below.

In each of the above-mentioned embodiments, although only one screw compressor is installed, a plurality of compressors can be used as in the case that a multistage compressor is formed. In this case, the compressor bodies 2 may be not only ones disposed at the same height position but also ones disposed in the up-down direction. Furthermore, in this case, the lower ends of the hanging wall faces of the cooling duct 8 may merely be extended downward so that the lower-end inlet 8A is not viewable from the center position X of the compressor body 2 at the lowest position.

With this configuration, since the noise emitted from the plurality of compressor bodies 2 is entirely diffracted and attenuated and then propagated to the cooling duct 8, the noise propagated to the exhaust opening 7 via the cooling duct 8 is suppressed. Furthermore, since the lower end of the cooling duct 8 is extended downward as described above, the cooling air can be flowed to the plurality of compressor bodies 2 along the lower sections of each of the compressor bodies 2, and the effect of cooling the compressor bodies 2 and the drive motor 3 can be improved.

Furthermore, in each of the above-mentioned embodiments, consideration is given to leakage suppression of the noise emitted from the compressor body 2 of the screw compressor from the exhaust opening 7; however, in addition to this, consideration may also be given to leakage suppression of the noise emitted from the drive motor 3 from the exhaust opening 7. For this, for example, in Embodiment 7 and Embodiment 8, the lower end positions of the hanging wall faces of the cooling duct 8 may merely be extended so as to be made lower than both the center position X of the compressor body 2 and the center position of the drive motor 3. Moreover, in Embodiment 1, Embodiment 3 and Embodiment 6, the right side wall 83 may merely be extended downward, and the lower end positions of the front wall 81, the left side wall 82 and the right side wall 83 may merely be made lower than both the center position X of the compressor body 2 and the center position of the drive motor 3. Still further, in Embodiment 4, the front wall 81 may merely be extended downward, and the lower end positions of the front wall 81 and the left side wall 82 may merely be made lower than both the center position X of the compressor body 2 and the center position of the drive motor 3.

Although the air intake port 2A of the screw compressor is provided with the intake filter 2B in Embodiment 6, the air intake port 2A in each of the other embodiments may similarly be provided with the intake filter 2B.

In Embodiment 4, the right side wall 83 of the cooling duct 8 is used in common as the right side plate 1B of the package 1, and in Embodiment 5, the front wall 81 of the cooling duct 8 is used in common as the front plate 1E of the package 1. Similar to this, also in the other embodiments, one face or two faces of hanging wall faces of the cooling duct 8 may be used in common as one of the plate members of the front, rear, left and right of the package 1.

In each of the embodiments, although the compressor body 2 and the drive motor 3 are connected via the gear box 4, the compressor body 2 and the drive motor 3 may be connected as the same drive shaft. Furthermore, the compressor body 2 and the drive motor 3 may be connected coaxially via a coupling. Moreover, the compressor body 2 and the drive motor 3 may be connected by pulleys.

In each of the above-mentioned embodiments, an oil-cooled and air-cooled screw compressor is taken as an example; however, it may be replaced with an air-cooled screw compressor of water-jet type, oil-free type or the like instead of the oil-cooled type.

The present application is based on a Japanese patent application (Patent Application No. 2015-134117) filed on Jul. 3, 2015, the content thereof being incorporated herein by reference.

DESCRIPTION OF REFERENCE NUMERALS AND SIGNS

X . . . center position (of compressor body)
1 . . . package
2 . . . compressor body
2A . . . air intake port
3 . . . drive motor
5 . . . first intake opening
6 . . . second intake opening
7 . . . exhaust opening
8 . . . cooling duct (duct)
8A . . . lower-end inlet
9 . . . propeller fan (as exhaust fan)
10 . . . heat exchanger
21 . . . screw rotor
22 . . . screw rotor
810 . . . exhaust duct
820 . . . intake duct
910 . . . turbo fan (as exhaust fan)

The invention claimed is:

1. A package-type air-cooled screw compressor comprising:

a compressor body equipped with a screw rotor for compression;

a drive motor that drives the screw compressor;

a package that houses the compressor body and the drive motor;

an intake opening formed in the package, for taking in an air that cools the compressor body and the drive motor;

an exhaust opening formed in an upper section of the package, to exhaust the air after the cooling of the compressor body and the drive motor;

a duct extended downward from the exhaust opening to a lower-end inlet that opens at least downward, to transport the air after the cooling of the compressor body and the drive motor to the exhaust opening; and an exhaust fan that exhausts the air after the cooling of the compressor body and the drive motor, wherein the duct includes a front wall, a rear wall, and one or more side walls, the front wall being a wall of the duct positioned closer to the compressor as compared to the rear wall and is extended downward beyond a bottom edge of the rear wall so that the lower end inlet of the duct is placed at a position not viewable from a center position of the compressor body, and the compressor body and the drive motor are coaxially connected and disposed in a bottom section of the package.

2. The package-type air-cooled screw compressor according to claim 1, wherein a lower end of the front wall of the duct is extended downward so that the lower-end inlet is not viewable from both the center position of the compressor body and a center position of the drive motor.

3. The package-type air-cooled screw compressor according to claim 1, wherein the screw compressor is composed of a plurality of compressors, and a lower end of the front wall of the duct is extended downward so that the lower end inlet is not viewable from a center position of a lowest compressor among the plurality of compressors.

4. The package-type air-cooled screw compressor according to claim 1, wherein the screw compressor comprises an air intake port that sucks in an air for compression, and the air intake port is disposed at a position not capable of viewing the lower end inlet of the duct.

5. The package-type air-cooled screw compressor according to claim 4, wherein the intake opening comprises a first intake opening that takes in the cooling air that mainly cools the compressor body and the air for compression to be sucked into the compressor body, and the air intake port is provided in a middle of a flow of the cooling air flowing from the first intake opening to the compressor body.

6. The package-type air-cooled screw compressor according to claim 5, wherein the first intake opening is formed at a position above the air intake port and the compressor body.

7. The package-type air-cooled screw compressor according to claim 1, wherein a turbo fan is used as the exhaust fan, the duct comprises an exhaust duct on a blowing side of the turbo fan, being provided between the turbo fan and the exhaust opening, and an intake duct on an intake side of the turbo fan, having a cross-sectional area smaller than that of the exhaust duct, and the lower end inlet of the duct is a lower end inlet of the intake duct.

8. The package-type air-cooled screw compressor according to claim 1, wherein a lower end of the wall constituting the duct extends downward only to a position on a horizontal plane passing through the center axis of the screw rotor.

* * * * *